United States Patent [19]

Bennett

[11] Patent Number: 4,742,931

[45] Date of Patent: May 10, 1988

[54] TOTE BOX TRAY

[75] Inventor: George Bennett, Simi Valley, Calif.

[73] Assignee: Olympic Plastics, Inc., Los Angeles, Calif.

[21] Appl. No.: 85,896

[22] Filed: Aug. 17, 1987

[51] Int. Cl.[4] ..... B65D 21/00

[52] U.S. Cl. ..... 220/23.86; 220/22.3; 220/69; 220/72

[58] Field of Search ..... 220/69, 72, 22.3, 23.83, 220/23.86, 7 F, 22, 73; 206/427, 514, 561, 328, 334

[56] References Cited

U.S. PATENT DOCUMENTS

| | | | |
|---|---|---|---|
| 3,311,257 | 3/1967 | Puente | 220/72 X |
| 3,327,896 | 6/1967 | Asenbauer | 220/73 X |
| 4,261,465 | 4/1981 | Thomas | 220/22.3 X |
| 4,499,997 | 2/1985 | Swingley . | |
| 4,572,368 | 2/1986 | Miller et al. | 220/23.86 X |
| 4,655,360 | 4/1987 | Juhanson | 220/69 |

*Primary Examiner*—Steven M. Pollard
*Attorney, Agent, or Firm*—William W. Haefliger

[57] ABSTRACT

An inexpensive molded plastic tray or receptacle constructed with ribs, slots and bumpers to fittingly receive the lower portion of a standard, i.e. older type tote box, the tray also being constructed to be recognized by sensors in an automatic retrieval and storage system so as to be controllably moved in that system along with its received standard tote box.

14 Claims, 2 Drawing Sheets

TOTE BOX TRAY

BACKGROUND OF THE INVENTION

This invention relates generally to tote boxes, and more particularly to means to enable continued use of older tote boxes in automatic retrieval and storage systems.

At the present time, automatic retrieval and storage systems make use of special tote boxes adapted for such systems. Such special tote boxes are constructed to be recognized by sensors, such as photo-electric sensors, allowing computerized control of tote box movement thereby facilitating storage and retrieval. It is highly expensive to convert to such systems, since older tote boxes cannot be employed and new boxes must be acquired and paid for. There is need for simple means allowing use of older boxes in automatic retrieval and storage systems.

SUMMARY OF THE INVENTION

It is a major object of the invention to provide method and means satisfying the above need. Basically, the invention contemplates the provision of an inexpensive tray or receptacle constructed to fittingly receive the lower portion of a standard, i.e. older type tote box, the tray also being constructed to be recognized by sensors in an automatic retrieval and storage system so as to be controllably moved in that system along with its received standard tote box.

It is another object to provide a lightweight, molded plastic tray meeting the above need.

It is a further object of the invention to provide a tray having external flat or pad means thereon to carry coding recognizable by sensors, and in such a way as to be protected during tray movement and collision with guide surfaces or other trays.

It is a still further object of the invention to provide a novel, lightweight and rugged carrier tray comprising, in combination:

(a) the tray being a single unit and having a bottom wall, two longitudinally spaced and upright end walls, and two laterally spaced and upright side walls, (b) the tray having approximately 90° curved corner walls each of which connects a side wall to an end wall, (c) the tray having bumper means which is integral with said side, end and corner walls and projects outwardly from top portions of said walls, (d) each of the side and end walls forming first vertical and alternating slots and ribs which are spaced apart along the inner side of the wall length for interfitting reception of vertical ribs on a tote box to be received in the tray, (e) the side and end walls also forming second vertical and alternating slots and ribs which are spaced apart along the outer side of each wall length in two groups, (f) and the outer side of at least one of said side and end walls also forming an intermediate flat located between said two groups of second slots and ribs, the flat facing outwardly and adapted to carry coding below the level of said bumper means.

As will be seen, the above unique tray may include coding on said flat, the flat having a length which is at least as long as the combined widths of three of said second ribs and three of said second slots; and each of the side and end walls of the tray may form one of such flats. In addition, on the inner side of at least one of the side and end walls, or on each such wall, there may advantageously be formed third narrow integral ribs which extend vertically and define third vertical slots, there being twice as many of said third slots and ribs per unit length of that side wall as there are of said first slots and ribs, per unit length of that wall, said third slots and ribs located opposite the flat on said wall. In this environment the bumper means may include first sections projecting outwardly from the walls, and vertically and downwardly projecting second sections offset outwardly from the walls. Accordingly, the coding on the flats is protected.

Additional features include textured curved corner walls for photo-electric sensing; non-reflective surfaces on the flats; and tray roughened bottom surfaces.

These and other objects and advantages of the invention, as well as the details of an illustrative embodiment, will be more fully understood from the following specification and drawings, in which:

DRAWING DESCRIPTION

DETAILED DESCRIPTION

Figure 1:
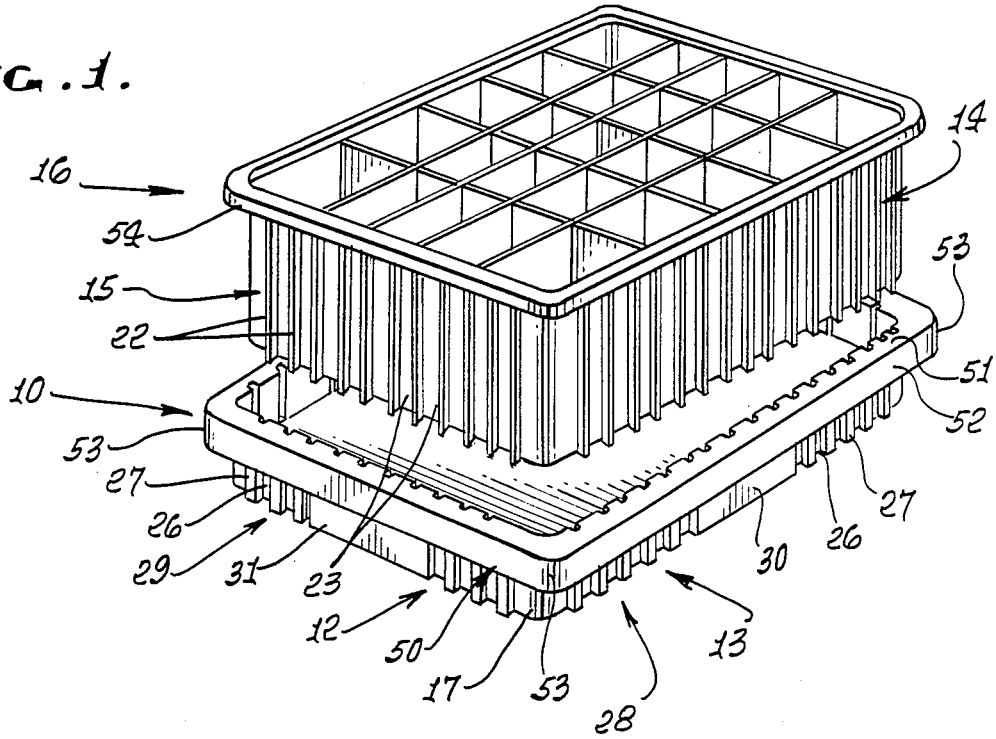
FIG. 1 is a perspective view of a tote box and tray.

In the drawings, a tote box carrier tray 10, is molded from synthetic resin as a single unit, and to have a bottomwall 11, two longitudinally spaced and upright end walls 12 which are alike, and two laterally spaced and upright side walls 13. The tray is shallow, and its walls have the same vertical dimension "d", which typically is about 2½ inches, and less than one-half the vertical dimensions of the side and end walls 14 and 15 of the tote box 16 received in the carrier tray. Approximately 90° curved corner walls 17 are provided, and each of which connects a side wall 13 to an end wall 12.

Each of the side and end walls 12 and 13 forms first vertical and alternating slots 18 and ribs 19 which are spaced apart along the inner side of the wall length, and in two sections as at sections 20 on wall 13, and sections 21 and wall 12. These slots and ribs are sized to loosely interfit the ribs and slots 22 and 23 formed on the tote box walls received in the tray.

Figure 3:
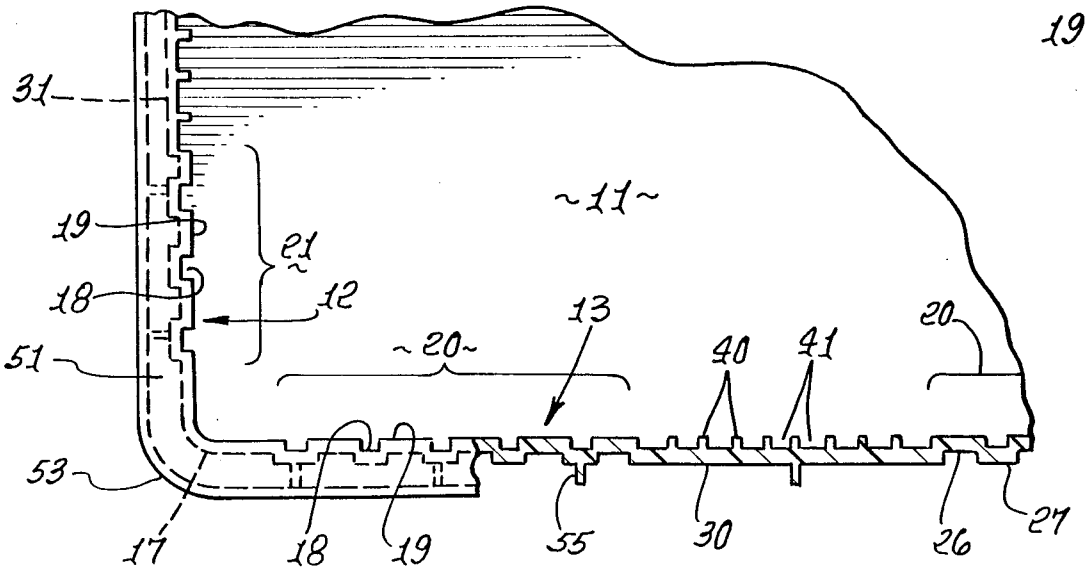
FIG. 3 is a fragmentary plan view on lines 3—3 of FIG. 2.

The side and end walls 12 and 13 also form second vertical and alternating slots and ribs 26 and 27 which are spaced apart along the outer side of each wall, in two groups as at groups 28 on wall 13, and groups 29 on wall 12. Slots 26 are opposite ribs 19, and ribs 27 are opposite slots 18, as seen in FIG. 3, whereby the walls 12 and 13 have minimum thickness, and the weight of the tray is minimized.

In addition the outer side of at least one of the side and end walls forms an intermediate flat located between the two groups of second slots and ribs, that flat facing outwardly and adapted to carry coding below the level of bumper means to be described. Typically, each side and end wall carries such a flat, as for example an elongated flat 30 on each side wall, and an elongated flat 31 on each end wall, flat 30 located between rib and slot groups 28, and flat 31 located between rib and slot groups 29.

Figure 5:
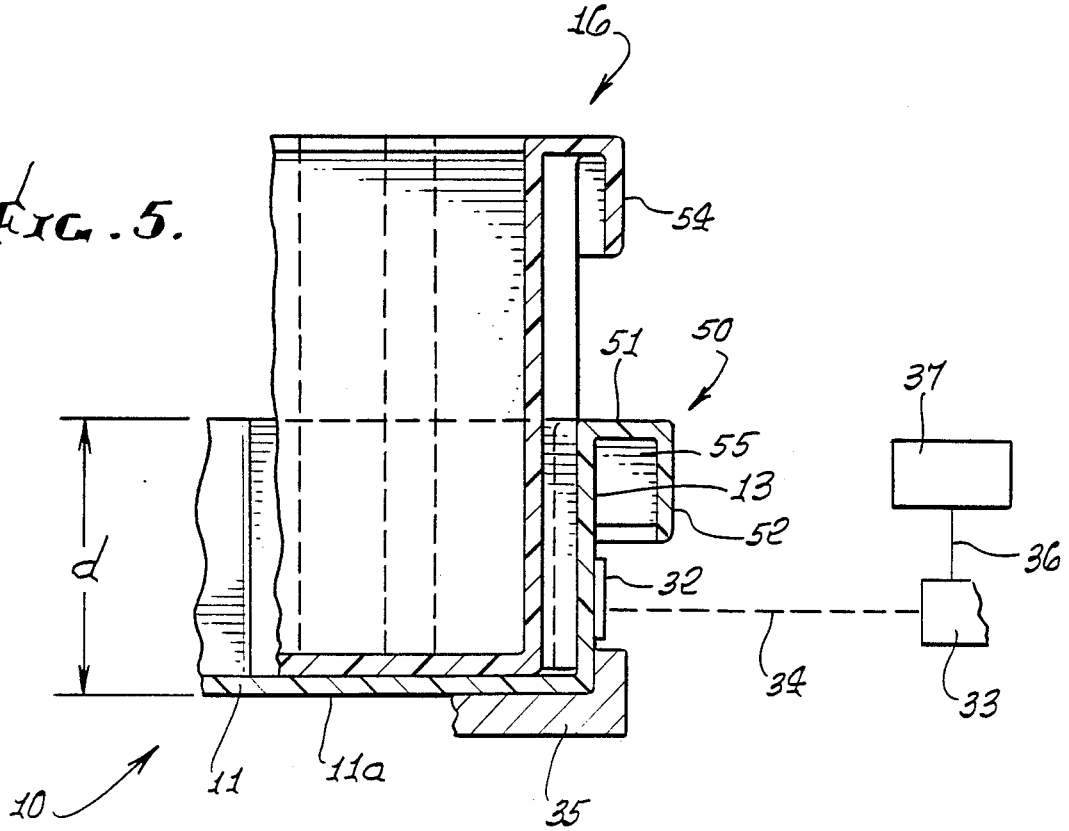
FIG. 5 is an enlarged section like that of FIG. 4, but showing reception of the tote box in the tray.
Figure 2:
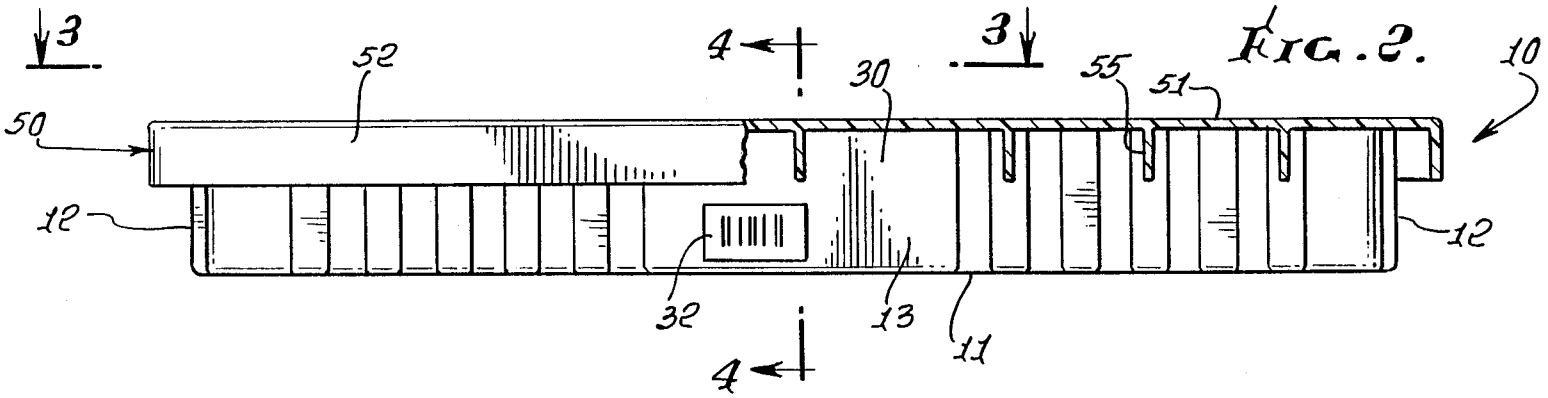
FIG. 2 is a side elevation showing the tray.
Figure 4:
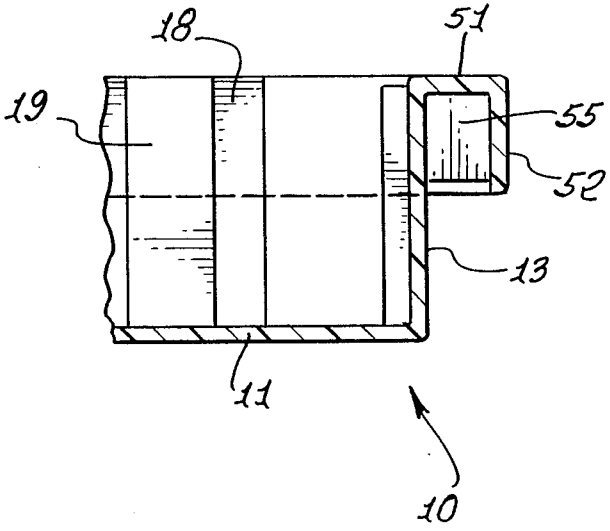
FIG. 4 is an enlarged fragmentary section on lines 4—4 of FIG. 2.

FIG. 2 shows a bar code label 32 attached to a flat 30 as by adhesive, and FIG. 5 shows a photo-electric or other type sensor 33 reading the bar code, as via beam 34 as the tray and recessed tote box along a guide way 35, in a direction normal to the plane of FIG. 5. Sensor 33 is connected at 36 to a computer 37 that may count or otherwise process the sensed bar code signal. The bar coding may represent the contents of the tote box, for example. Flats 30 and 31 may have lengths which are at least as long as the combined widths of three of the second ribs and slots 26 and 27, as seen in FIG. 1, whereby several codes or different sized codes may be employed on the flat. The flat typically is about 5½ inches long and 1½ inches in height.

The inner sides of the side and end walls define third, narrow, integral ribs 40 which extend vertically, and form the third vertical slots 41 between the ribs. These third ribs and slots are opposite the flats 30 and 31, and are employed to reduce weight, since the flats cannot form ribs and slots. Thus ribs 40 have width which is less than one-half the width of slots 41, and are spaced to accomodate reception of the ribs and slots of the tote box—for example successive tote box ribs are received in alternate slots 41. To this end, there are twice as many of the third slots and ribs per unit lengths of the side or end wall as there are of the first slots and ribs, per unit length of that wall.

The tray also has bumper means that is integral with the side, end and corner walls 12, 13 and 17, and that projects outwardly from top portions of the walls in protective relation with the flats and coding thereon. As shown, the bumper means 50 includes first wall sections 51 projecting outwardly from the walls 12, 13 and 17, as well as vertically and downwardly projecting second wall sections 52 offset outwardly from walls 12, 13 and 17. The bumper means forms 90° curved corners indicated at 53, as seen in FIG. 1. The bumper projects outwardly beyond the outermost projection of the bumper rail 54 on the tote box, to protect same from sideward collision with external structure. See FIG. 5. Also, strengthening ribs 55 are provided between projection 52 and walls 12 and 13, at intervals along the latter.

Finally, the curved corner walls 17 may be textured for photo-electric sensing of tray ends; the flats 30 may have non-reflective surfaces—i.e. roughened; and tray bottom wall may have a roughened, non-slip surface at 11*a*.

We claim:

1. A tote box carrier tray, comprising, in combination:

(a) the tray being a single unit and having a bottom wall, two longitudinally spaced and upright end walls, and two laterally spaced and upright side walls, (b) the tray having approximately 90° curved corner walls each of which connects a side wall to an end wall, (c) the tray having bumper means which is integral with said side, end and corner walls and projects outwardly from top portions of said walls, (d) each of the side and end walls forming first vertical and alternating slots and ribs which are spaced apart along the inner side of the wall length for interfitting reception of vertical ribs on a tote box to be received in the tray, (e) the side and end walls also forming second vertical and alternating slots and ribs which are spaced apart along the outer side of each wall length in two groups, (f) and the outer side of at least one of said side and end walls also forming an intermediate flat located between said two groups of second slots and ribs, the flat facing outwardly and adapted to carry coding below the level of said bumper means.

2. The tray of claim 1 including said coding on said flat, the flat having a length which is at least as long as the combined widths of three of said second ribs and three of said second slots.

3. The tray of claim 1 wherein each of said side and end walls forms one of said flats.

4. The tray of claim 3 wherein, on the inner side of each of the side and end walls there are third narrow integral ribs which extend vertically and define third vertical slots, there being twice as many of said third slots and ribs per unit length of that wall as there are of said first slots and ribs, per unit length of that wall, said third slots and ribs located opposite the flat on said wall.

5. The tray of claim 3 wherein each flat is at the mid-portion of one of the walls.

6. The tray of claim 3 wherein the bumper means projects outwardly from said walls to protect the coding on said flats.

7. The tray of claim 6 wherein the bumper means includes first sections projecting outwardly from the walls, and vertically and downwardly projecting second sections offset outwardly from the walls.

8. The tray of claim 1 wherein, on the inner side of at least one of the side and end walls, there are third narrow integral ribs which extend vertically and define third vertical slots, there being twice as many of said third slots and ribs per unit length of that side wall as there are of said first slots and ribs, per unit length of that wall, said third slots and ribs located opposite the flat on said wall.

9. The tray of claim 6 wherein, said third integral slots and ribs are located on each of said side and end walls.

10. The tray of claim 1 wherein each of the first slots is located opposite one of the second ribs.

11. The tray of claim 1 wherein the curved corner walls are textured, for photo-electric sensing.

12. The tray of claim 1 wherein said flat has a non-reflective surface.

13. The tray of claim 1 wherein the tray has a roughened bottom surface.

14. The tray of claim 1 in combination with a tote box received therein and having ribs meshing vertically with the first slots defined by the tray.

* * * * *